US008052390B1

(12) United States Patent
Liang

(10) Patent No.: US 8,052,390 B1
(45) Date of Patent: Nov. 8, 2011

(54) TURBINE AIRFOIL WITH SHOWERHEAD COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1027 days.

(21) Appl. No.: 11/975,667

(22) Filed: Oct. 19, 2007

(51) Int. Cl.
*F01D 25/18* (2006.01)

(52) U.S. Cl. ..... 416/97 R

(58) Field of Classification Search ..... 415/115, 415/178; 416/97 R
See application file for complete search history.

(56) References Cited

U.S. PATENT DOCUMENTS

| | | | |
|---|---|---|---|
| 3,688,833 | A | 9/1972 | Bykov et al. |
| 3,819,295 | A | 6/1974 | Hauser et al. |
| 3,934,322 | A | 1/1976 | Hauser et al. |
| 4,257,737 | A | 3/1981 | Andress et al. |
| 4,595,298 | A | 6/1986 | Frederick |
| 5,370,499 | A | 12/1994 | Lee |
| 5,374,162 | A | 12/1994 | Green |
| 5,486,093 | A | 1/1996 | Auxier et al. |
| 5,660,523 | A | 8/1997 | Lee |
| 5,779,437 | A | 7/1998 | Abdel-Messeh et al. |
| 6,099,251 | A | 8/2000 | LaFleur |
| 6,164,912 | A | 12/2000 | Tabbita et al. |
| 6,379,118 | B2 | 4/2002 | Lutum et al. |
| 7,021,896 | B2 | 4/2006 | Dodd |
| 7,114,923 | B2 | 10/2006 | Liang |

*Primary Examiner* — Ninh H Nguyen
(74) *Attorney, Agent, or Firm* — John Ryznic

(57) ABSTRACT

A turbine airfoil, such as a turbine blade, having a showerhead for cooling the leading edge region. A plurality of rows of exit film slots are arranged along the leading edge in the spanwise direction and staggered from each other. The exit slots are connected to narrow cooling air passages formed within the airfoil wall in which a plurality of rows of micro pin fins extend across the passage to form serpentine flow paths for the cooling air. Cooling air from a cooling air supply channel is metered into an impingement cavity to produce backside impingement cooling of the leading edge wall. The cooling air is diffused and then passed into the plurality of narrow cooling air passages to be metered again and serpentine flow through the narrow passages, and then diffused into the exit film slots. The cooling air is then ejected from the diffusion slots as a film layer of cooling air onto the leading edge airfoil surface. The narrows cooling air passages with the micro pin fins can also be arranged on the pressure side or the suction side walls of the airfoil to provide improved impingement and diffusion and film cooling for the airfoil surface.

18 Claims, 3 Drawing Sheets

View B-B

View B-B

TURBINE AIRFOIL WITH SHOWERHEAD COOLING

BACKGROUND OF THE INVENTION

1. Field of the Invention

The present invention relates generally to a gas turbine engine, and more specifically to a turbine airfoil with a showerhead leading edge cooling arrangement.

2. Description of the Related Art Including Information Disclosed Under 37 CFR 1.97 and 1.98

A gas turbine engine includes a turbine with one or more stages of rotor blades and stator vanes used to convert energy from the hot gas flow into mechanical work to drive the compressor or, in the case of an industrial gas turbine engine (IGT) to drive an electric generator. In order to extract the highest amount of mechanical energy, the hat gas flow is passed into the turbine having the highest possible temperature. However, the highest possible temperature at the turbine inlet is limited to the material capabilities of the first stage vanes and blades. if the blades or vanes become too hot, the parts can fail.

In order to allow for higher gas flow temperatures, the turbine airfoils are cooled by passing a pressurized cooling air through the internal passages formed within the airfoils. A combination of internal convection cooling with impingement and film cooling is sued in order to maximize the cooling ability while minimizing the amount of pressurized cooling air used.

The leading edge of the stator vanes and the rotor blades are exposed to the highest gas flow temperature and therefore require the highest amount of cooling to prevent hot spots. In the prior art, an airfoil leading edge is cooled with backside impingement in series with showerhead film cooling. showerhead film rows are supplied cooling air from a common impingement cavity and discharge the cooling air at various gas side pressures. U.S. Pat. No. 6,099,251 issued to LaFleur on Aug. 8, 2000 and entitled COOLABLE AIRFOIL FOR A GAS TURBINE ENGINE shows this type of leading edge cooling arrangement. As a result of this method for cooling the leading edge, cooling flow distribution and pressure ratio across the showerhead film holes for the pressure side and suction side film row is predetermined by the impingement cavity pressure. Also, the standard film slots pass straight through the airfoil wall at a constant diameter and exit at an angle to the surface. Some of the coolant is subsequently injected directly into the mainstream causing turbulence, coolant dilution and a loss of downstream film cooling effectiveness. And, the film slot breakout on the airfoil surface may induce stress problem in a blade cooling application.

U.S. Pat. No. 3,819,295 issued to Hauser et al on Jun. 25, 1974 and entitled COOLING SLOT FOR AIRFOIL BLADE discloses a turbine blade with a trailing edge cooling passage formed by rows of holes drilled at about 90 degrees offset to form square shaped nodes that act as turbulence promoters to the cooling air flow. One problem with the Hauser et al invention is that the passages are formed by drilling holes in the trailing edge blade material. Because the passages are formed by drilling holes, the passages for the cooling air do not flow in a serpentine path as is provided for in the present invention. Also, the drilled holes cannot be formed close to an end of the blade. The holes on the tip of the blade in Hauser et al have to be drilled from the tip and not from the trailing edge. On both the tip and the bottom of the trailing edge in the Hauser et al invention, the holes for the cooling air to pass are not formed near the inner or outer extremes because the holes cannot be drilled without passing through the material on the extremes as is accomplished in the present invention and described below. Thus, the method of forming cooling air passages cannot be used to form cooling holes for the leading edge showerhead of the turbine airfoil as is the case for the present invention.

BRIEF SUMMARY OF THE INVENTION

It is an object of the present invention to provide for a turbine airfoil with a leading edge that has a reduced metal temperature in order to reduce the cooling flow requirement and improve the turbine efficiency.

It is another object of the present invention to provide for a turbine airfoil showerhead arrangement that can accomplish the above objective and also be cast with the airfoil.

It is another object of the present invention to minimize the amount of stress concentration formed on the leading edge airfoil surface due to film cooling holes.

A showerhead arrangement of film cooling slots is formed on the airfoil leading edge to provide film cooling air. A number of rows of film cooling slots extend along the leading edge in the airfoil spanwise direction and in a staggered arrangement. Separate cooling air passages connect the impingement cavity to the film slots in which a plurality of rows of micro pin fins are formed to extend across the walls of the passages and form serpentine flow paths in the passages. The micro pin fins are cast into the airfoil leading edge during the airfoil casting process. the staggered array of pin fins provide for a high heat transfer coefficient and the film slots provide for diffusion of the cooling air passing from the pin fins in order that a smooth film layer of cooling air is provided for on the airfoil surface.

DETAILED DESCRIPTION OF THE INVENTION

Figure 1:
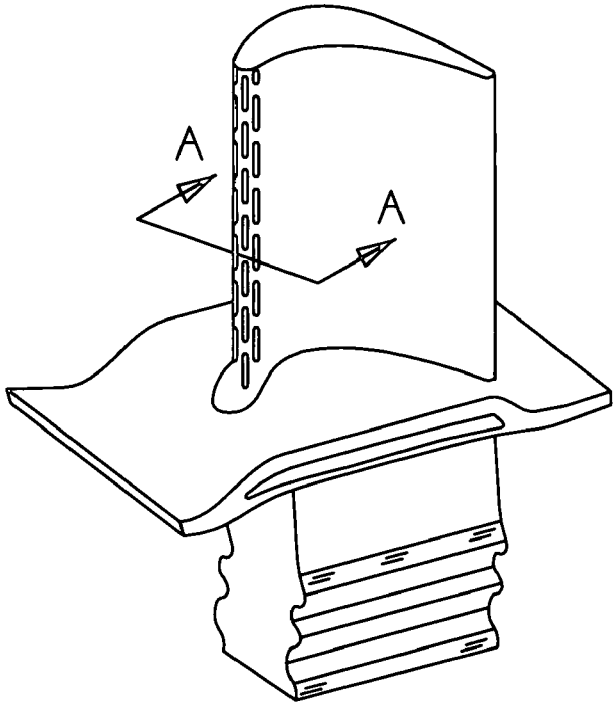
FIG. 1 shows a schematic view of a turbine blade with the showerhead arrangement of the present invention.

The present invention is disclosed as a showerhead cooling hole circuit for a turbine rotor blade as shown in FIG. 1. However, the showerhead of the present invention can be used cool the leading edge of a stator vane, or can be used to cool the pressure side or the suction side wall of a turbine blade or vane.

FIG. 1 shows a turbine blade with a root portion and a platform extending from the blade root, and an airfoil portion extending from the platform and having the airfoil shape with a leading edge. The leading edge showerhead is clearly shown in FIG. 1 with a number of rows of film slots positioned at a staggered array around the leading edge. In this case there are three rows extending in the spanwise direction such that one row is located on the pressure side of the leading edge, a second or middle row is located about at the stagnation point, and the third row is located on the suction side.

Figure 2:
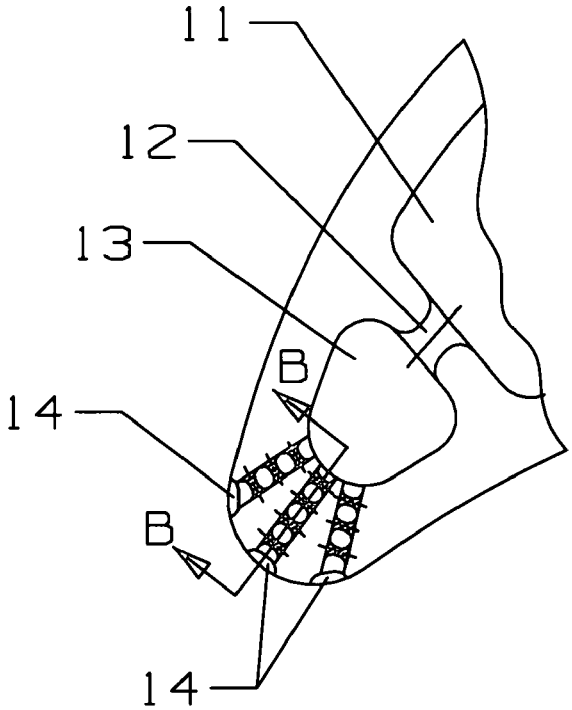
FIG. 2 shows a cross section top view of the leading edge cooling circuit of the present invention.

FIG. 2 shows a cross section view along the lines A-A in FIG. 1 in which the blade includes an internal cooling air supply channel 11 to deliver pressurized cooling air to the blade from an external source such as the compressor, a metering and impingement hole 12, a leading edge impingement cavity 13 connected to the cooling supply channel 11 through the metering hole 12, and a showerhead arrangement of three cooling slots 14 arranged around the leading edge of the airfoil. The impingement cavity 13 can be one long cavity extending along the entire airfoil to discharge cooling air through a row of metering holes, or a number of segmented cavities each with one or more metering holes to supply impingement cooling air to the individual segment cavities.

Figure 3:
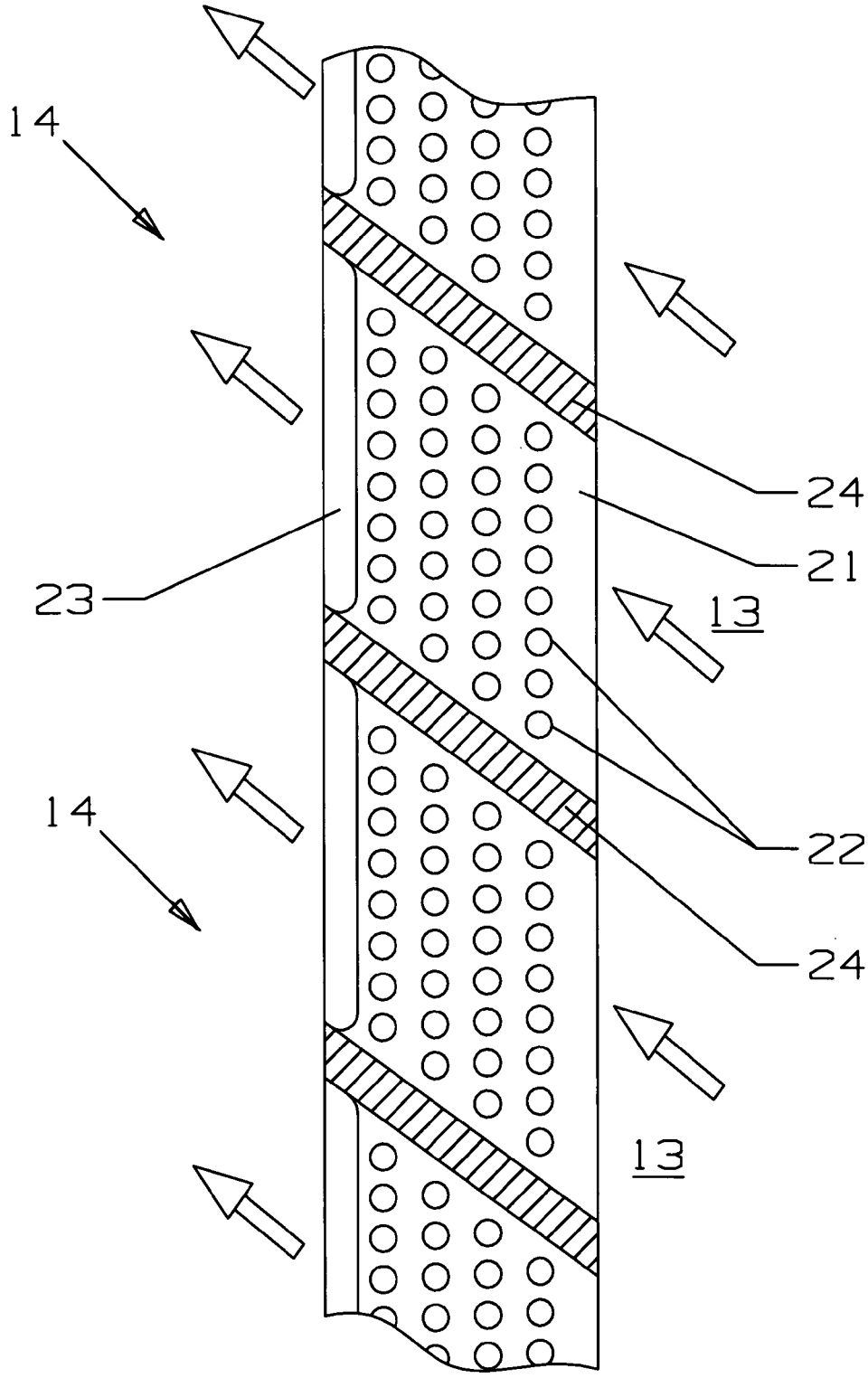
FIG. 3 shows a cross section side view of the leading edge cooling circuit of the present invention.

FIG. 3 shows a side cross section view of the showerhead cooling holes through the line B-B shown in FIG. 2. The middle hole of the showerhead is shown in the cross section of FIG. 3 and includes ribs 24 that define a cooling passage between two ribs 24. An inlet opening 21 is formed on the upstream or inlet end of the cooling passage, and an outlet slot 23 is formed on the downstream or outlet end of the passage. The ribs 24 are angled upwards toward the blade tip, but the ribs 24 can extend along the chordwise direction without being angled. Extending across the walls in the passage are several rows of pin fins 22 arranged in-line or at a staggered array to form cooling air passages between the pin fins 22. the pin fins 22 in one row are offset from the pin fins in an adjacent row so that a serpentine flow path is formed between the pin fins to increase the heat transfer coefficient as the cooling air passes through the passage.

The pin fins 22 are cast into the airfoil leading edge during the casting process for the blade. The pin fins are micro sized with a pin fin density in the range of 40% to 70% blockage within the passage between the ribs 24. The micro pin fins 22 have a diameter in the range of 0.02 inch to 0.05 inch. Each individual passage between adjacent ribs 24 can have the pin fins 22 constructed in a staggered or an inline array and with different densities and diameters in order to more precisely control the amount of cooling air flow and the heat transfer coefficient in the passage for each passage or duct on the showerhead.

Figure 4:
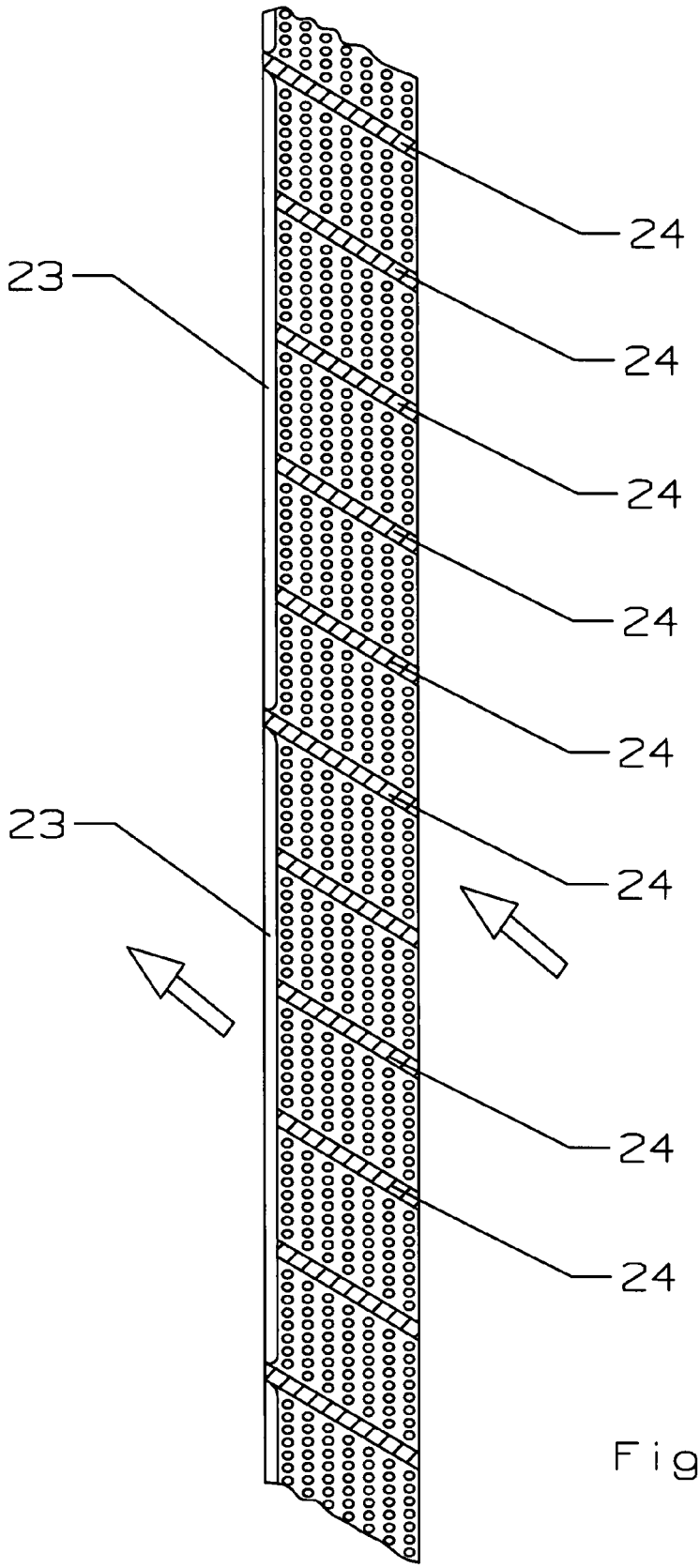
FIG. 4 shows a cross section side view of a second embodiment of the leading edge cooling circuit of the present invention.

In the FIG. 3 embodiment, each slot 23 was formed between adjacent ribs 24 with the pin fins 22 extending within the passage thus formed. In the FIG. 4 embodiment, one of the outlet slots extends between several of the ribs 24. In the case of the FIG. 4 embodiment, one slot 23 is connected to passages separated by 6 ribs 24 to form a larger film slot 23 with smaller pin fin channels or passages leading into the larger slot 23.

Because the pin fins are cast into the blade as the blade is cast, the pin fins can be formed close to the ribs so that a staggered arrangement of pin fins can be formed in which a serpentine flow is formed between pin fins even right up against the rib. This cannot be formed in the drilled holes of the Hauser et al patent described above in the Prior Art.

The ribs and the pin fins of the present invention form a plurality of modules with multi-metering and diffusion micro pin fins to produce film cooling for the airfoil leading edge. The modules are small in order that each individual module can be designed based on a gas side discharge pressure in both chordwise and spanwise directions as well as designed at a desired coolant flow distribution for the showerhead film rows. The micro pin fin density and/or diameter for each film cooling module can be altered within each film row in the spanwise direction for control of the cooling flow area, blockage and pressure drop across the micro pin fins. The individual small modules can be constructed in a staggered or an inline array among the showerhead rows. With the showerhead construction of the present invention, the usage of cooling air for a given airfoil inlet gas temperature and pressure profile is maximized.

In operation, cooling air is supplied through the airfoil leading edge flow cavity 11 and metered through the metering and impingement holes 12 to impinge onto the backside of the leading edge surface and diffuse the cooling air into the diffusion cavity 13. The cooling air is then further metered through the multiple rows of micro pin fins and then diffused into the continuous exit slots prior to discharge from the airfoil to form a film sub-layer for cooling of the airfoil leading edge region.

In addition, the cooling air is metered through the multiple micro pin fin rows in each small individual diffusion module which allows the cooling air to diffuse uniformly into a continuous slot to reduce the cooling air exit momentum. If the cooling air momentum is too great, the cooling air will be ejected out from the airfoil leading edge surface with enough velocity to prevent the formation of a film layer against the airfoil surface. Coolant penetration into the gas path is thus minimized, yielding good buildup of the coolant sub-boundary layer next to the airfoil surface, and better film coverage in the chordwise and spanwise directions for the airfoil leading edge region. Since the multi-diffusion module utilizes the continuous slot design instead of individual film holes on the airfoil surface, stress concentration is minimized.

In order to better control the coolant flow, enhanced the leading edge film cooling, and minimize stress induced by the film holes, the double usage of cooling air in the small individual diffusion module enhances the airfoil leading edge internal convection capability and the continuous discrete slots are utilized for the showerhead rows to reduce the amount of the hot gas surface. This results in a reduction of the airfoil total heat load into the airfoil leading edge region.

The narrow cooling air passages with the micro pin fins formed in the passages can also be used on the pressure side or the suction side walls of the airfoil to provide film cooling onto the outer airfoil surface. Impingement cavities are formed upstream of the narrow cooling air passages to produce the impingement cooling of the backside surface and diffusion of the cooling air. The cooling air then passes through the plurality of narrow cooling air passages and through the serpentine paths and into the exit film slots to be further diffused. The cooling air is then ejected onto the airfoil surface as a film layer of cooling air.

I claim the following:

1. A showerhead for a turbine airfoil comprising:

a cooling air passage having an inlet and an outlet and formed by walls on the sides and ribs on the top and bottom;

the cooling air passage having a constant cross sectional flow area from the inlet to the outlet;

a continuous exit slot on the outlet of the cooling air passage;

a plurality of pin fins extending between the walls and into the cooling air passage; and, the height of the cooling air passage being much greater than the width of the cooling air passage.

2. The showerhead of claim 1 above, and further comprising:

the pin fins are micro pin fins having a diameter in the range of 0.02 to 0.05 inches.

3. The showerhead of claim 2 above, and further comprising:

the pin fins have a density in the range of 40% to 70% blockage per row.

4. The showerhead of claim 1 above, and further comprising:

the pin fins are arranged in rows that are staggered such that a serpentine flow path is formed for the cooling air.

5. The showerhead of claim 1 above, and further comprising:

a plurality of cooling air passages each separated by a rib opens into a single continuous exit slot.

6. The showerhead of claim 1 above, and further comprising:

a first row of slots extending in a spanwise direction of the airfoil and on the pressure side of the leading edge;

a second row of slots extending in a spanwise direction of the airfoil and substantially along the stagnation point of the leading edge;

a third row of slots extending in a spanwise direction of the airfoil and on the suction side of the leading edge; and, the three rows of slots being staggered in the spanwise direction such that a full film layer is formed on both sides of the leading edge.

7. A showerhead for a turbine airfoil comprising:

a cooling air passage having an inlet and an outlet and formed by walls on the sides and ribs on the top and bottom;

a continuous exit slot on the outlet of the cooling air passage;

a plurality of pin fins extending between the walls and into the cooling air passage;

the height of the cooling air passage being much greater than the width of the cooling air passage; and, the ribs are angled in an upward direction.

8. A process for cooling a leading edge region of a turbine airfoil, the turbine airfoil having an internal cooling air supply channel, a leading edge impingement cavity, and a metering hole connecting the supply channel to the impingement cavity, the process comprising the steps of:

metering cooling air from the supply channel;

impinging the metered air onto the backside of the leading edge wall;

diffusing the impinging air into the impingement cavity;

metering the cooling air through a serpentine path in the leading edge wall;

diffusing the metered cooling air into a slot on the airfoil wall; and, forming a sub-layer of film cooling air onto the airfoil leading edge surface.

9. The process for cooling a leading edge region of a turbine airfoil of claim 8 above, and further comprising the step of:

metering the cooling air from the diffusing cavity through a plurality of serpentine paths spaced around the leading edge region.

10. The process for cooling a leading edge region of a turbine airfoil of claim 8 above, and further comprising the step of:

metering the cooling air through a serpentine path in the leading edge wall in a direction upward toward the airfoil tip.

11. The process for cooling a leading edge region of a turbine airfoil of claim 8 above, and further comprising the step of:

the step of metering the cooling air through a serpentine path in the leading edge wall includes metering the cooling air through a plurality of serpentine paths all in fluid communication within the wall.

12. The process for cooling a leading edge region of a turbine airfoil of claim 8 above, and further comprising the step of:

metering the cooling air through a plurality of separate serpentine paths in the leading edge wall into a common diffusion slot on the airfoil leading edge wall.

13. A turbine airfoil for use in a gas turbine engine, the turbine airfoil comprising:

an outer wall surface exposed to a hot gas flow that requires film cooling;

an inner wall surface that defines part of an impingement cavity;

a narrow cooling air passage formed between the outer wall surface and the inner wall surface and having a plurality of pin fins extending between the sides of the passage;

the narrow cooling air passage having a constant cross sectional flow area from the inlet to the outlet; and, a continuous exit film slot on the outer wall surface and connected to the narrow cooling air passage such that the cooling air flowing in the serpentine paths formed by the pin fins is diffused into the exit film slot and then discharged onto the outer wall surface as a film layer of cooling air.

14. The turbine airfoil for claim 13 above, and further comprising:

a plurality of rows of pin fins in the cooling air passage, the rows extending in the spanwise direction of the airfoil, and the rows being staggered to form the serpentine flow paths.

15. The turbine airfoil for claim 14 above, and further comprising:

the pin fins are micro pin fins having a diameter in the range of 0.02 to 0.05 inches.

16. The turbine airfoil for claim 13 above, and further comprising:

a plurality of cooling air passages opening into a common continuous exit film slot.

17. The turbine airfoil for claim 13 above, and further comprising:

a second narrow cooling air passage located in the wall and adjacent to the first narrow cooling air passage;

both the first and the second cooling air passages being connected to the same impingement cavity;

a second continuous exit film slot on the outer wall surface connected to the second narrow cooling air passage; and, the first and the second continuous exit film slot being side by side on the outer airfoil wall and offset in the airfoil spanwise direction.

18. A turbine airfoil for use in a gas turbine engine, the turbine airfoil comprising:

an outer wall surface exposed to a hot gas flow that requires film cooling;

an inner wall surface that defines part of an impingement cavity;

a narrow cooling air passage formed between the outer wall surface and the inner wall surface and having a plurality of pin fins extending between the sides of the passage;

a continuous exit film slot on the outer wall surface and connected to the narrow cooling air passage such that the cooling air flowing in the serpentine paths formed by the pin fins is diffused into the exit film slot and then discharged onto the outer wall surface as a film layer of cooling air; and, the cooling air passage being formed by an upper rib and a low rib each slanting upward in the airfoil spanwise direction.

* * * * *